US007013515B1

(12) United States Patent
Price

(10) Patent No.: US 7,013,515 B1
(45) Date of Patent: Mar. 21, 2006

(54) BODY IMPRESSION-RESISTANT MATTRESS ASSEMBLY

(76) Inventor: J. Wesner Price, 8202 Old State Rd., Cameron, SC (US) 29030

( * ) Notice: Subject to any disclaimer, the term of this patent is extended or adjusted under 35 U.S.C. 154(b) by 0 days.

(21) Appl. No.: 10/789,434

(22) Filed: Feb. 27, 2004

(51) Int. Cl.
*A47C 27/05* (2006.01)

(52) U.S. Cl. ..... 5/721; 5/716; 5/728; 5/701

(58) Field of Classification Search ..... 5/701, 5/716, 717, 721, 728, 739
See application file for complete search history.

(56) References Cited

U.S. PATENT DOCUMENTS

| | | | | |
|---|---|---|---|---|
| 1,682,394 | A | 8/1928 | Meutsch | |
| 3,370,306 | A | 2/1968 | Lovette | |
| 3,751,742 | A | 8/1973 | Worley | |
| 4,449,261 | A | 5/1984 | Magnusson | |
| 4,462,129 | A | 7/1984 | Brannock | |
| 4,745,645 | A | 5/1988 | McWilliams | |
| 5,107,558 | A | 4/1992 | Lück | |
| 5,319,814 | A * | 6/1994 | Dyer, Jr. | 5/701 |
| 5,523,144 | A * | 6/1996 | Dyer, Jr. | 428/158 |
| 5,579,549 | A * | 12/1996 | Selman et al. | 5/721 |
| 6,098,224 | A | 8/2000 | Gladney | |
| 6,202,238 | B1 * | 3/2001 | Mossbeck et al. | 5/717 |
| 6,308,354 | B1 * | 10/2001 | Lilly et al. | 5/721 |
| 6,353,952 | B1 | 3/2002 | Wells | |
| 6,360,390 | B1 * | 3/2002 | Bonaddio | 5/717 |
| 6,374,442 | B1 | 4/2002 | Wells | |
| 6,481,033 | B1 | 11/2002 | Fogel | |
| 6,701,557 | B1 * | 3/2004 | Barman | 5/730 |
| 2001/0008030 | A1 | 7/2001 | Gladney et al. | |
| 2002/0112292 | A1 | 8/2002 | O'Brien | |

FOREIGN PATENT DOCUMENTS

| | | |
|---|---|---|
| DE | 3128894 | 2/1983 |
| EP | 0032805 | 7/1981 |
| EP | 0314059 | 5/1989 |

* cited by examiner

*Primary Examiner*—Michael Trettel
(74) *Attorney, Agent, or Firm*—Nelson Mullins Riley & Scarborough LLP

(57) ABSTRACT

A body impression resistant mattress assembly comprised of an inner mattress unit, at least one raised sleep zone, a first cushion top, and an outer cover encasing the raised sleep zone and the first cushion top. The insert is sized and located within the mattress so that it inhibits the formation of body impressions.

33 Claims, 7 Drawing Sheets

BODY IMPRESSION-RESISTANT MATTRESS ASSEMBLY

BACKGROUND OF THE INVENTION

The present invention relates generally to mattresses, and more particularly to a mattress constructed to inhibit the formation of body impressions.

As known to those of skill in the art, body impressions are permanent deflections in the sleep surface of a mattress that occur over time due to repeated loading and unloading of the sleep surface. Loading and unloading usually occur when a person mounts a mattress to sleep and then dismounts the mattress when he or she awakes. Formation of body impressions is a significant problem in the mattress industry because consumers often return mattresses with body impressions and expect a refund or replacement under a warranty.

Conventional mattresses typically consist of an inner spring unit in the core of the mattress, a layer of padding around the inner spring unit, and a layer of fabric or upholstery around the outside of the mattress to hold everything together. Often, the inner spring unit may be made of a spring system containing many individual coil springs tied together by metal wire or some other attachment means. In other cases, the inner spring unit may be formed of many individual pocketed coil springs attached together to form a spring system. Foam, ticking, polyester, natural fibers like cotton, a combination of any of these materials, or other suitable materials typically make up the padding around the inner spring unit. A third less common type of mattress utilizes a foam core instead of a spring unit.

The construction of conventional mattresses may lead to the formation of body impressions. A body impression is a permanent defection in the mattress in the shape of the user's body. This permanent deflection creates a non-uniform surface which is unsupportive, uneven, bumpy, misshapen, and uncomfortable for the sleeper.

Commonly, it is a breakdown in the padding around the spring system that causes the formation of body impressions, not a breakdown of the spring system itself. A mattress with a foam core and no spring system is even more susceptible to the formation of body impressions because it lacks a resilient spring unit.

Because body impressions are costly to the mattress industry and leave sleepers with a poor sleep surface, there is a need in the art for additional novel mattress constructions.

SUMMARY

The present invention recognizes and addresses considerations of prior art constructions and methods.

According to one aspect, the present invention is directed to a mattress comprising an inner mattress unit, an outer cover, a first cushion top, and at least one raised sleep zone. The inner mattress unit has opposite first and second sides. The first cushion top is of a predetermined thickness and is positioned between the first side of the inner mattress unit and the outer cover. The raised sleep zone is formed between the outer cover and the inner mattress unit. The planar surface area of the raised sleep zone or zones is less than the planar surface area of the first side of the inner mattress unit. In addition, the raised sleep zone is sized and positioned to inhibit the formation of body impressions.

Another aspect of the present invention is directed to a body impression-resistant mattress assembly comprised of an inner mattress unit having a rectangular shape, a first insert, a first cushion top, and an outer upholstery layer. The inner mattress unit has opposite first and second sides. The first insert is adjacent to the first side of the inner mattress unit and is configured to inhibit the formation of body impressions. The planar surface area of the first insert is preferably less than the surface area of the first side of the inner mattress unit. The first cushion top has a predetermined thickness and is configured to cover the first insert and a part of the first side of the inner mattress unit not covered by the first insert.

Yet another aspect of the present invention is directed to a mattress with an inner mattress unit further comprised of a foam base located adjacent to and generally coextensive with the second side of the inner mattress unit. In some embodiments, a second insert may be located side-by-side with the first insert on the first side of the inner mattress unit. The thickness of the inserts will often be between about one-half and one inch in many embodiments. When only one side of the inner mattress unit is fitted with inserts, the thickness of the insert may preferably be about one inch. When both sides of the inner spring are fitted with inserts, the thickness may preferably be about one-half inch.

The inner mattress unit could be comprised of a plurality of individual pocketed coil springs, or a plurality of individual coil springs. To improve the stiffness of the mattress edges, the mattress could further comprise side rails around the perimeter of the inner mattress unit. These side rails preferably are encased by a foam perimeter. If desired, the mattress also could comprise a pillow top adjacent to the outer cover.

The accompanying drawings, incorporated in and constituting part of this specification, illustrate one or more embodiments of the present invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
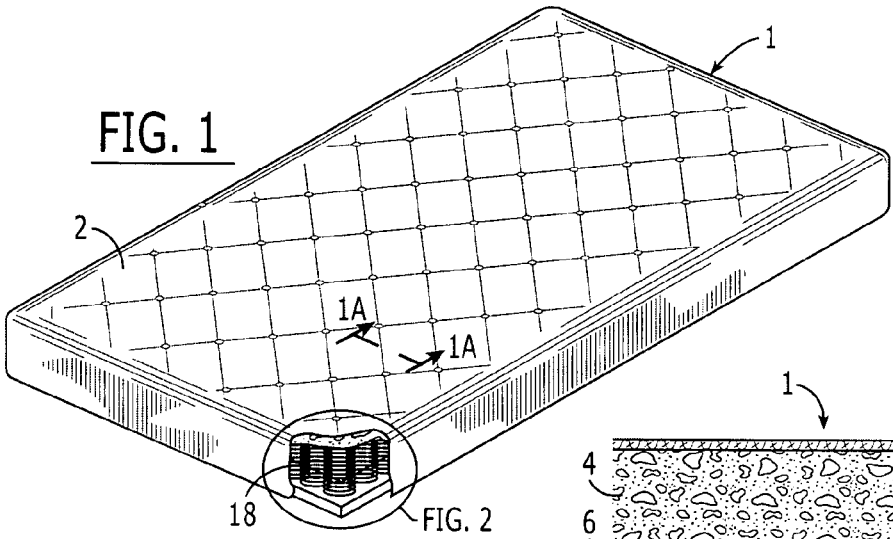
FIG. 1 is a perspective view of a one-sided mattress with outer layers cut away in one corner to show internal details.

Repeated use of reference characters in the present specification and drawings is intended to represent same or analogous features or elements of the invention.

DETAILED DESCRIPTION OF PREFERRED EMBODIENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 1A:
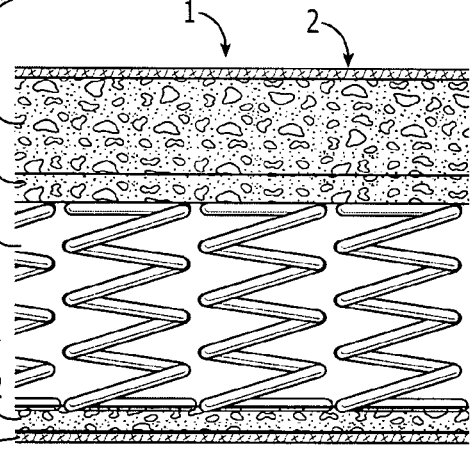
FIG. 1A is a cross-sectional view of a portion of the mattress of FIG. 1.
Figure 2:
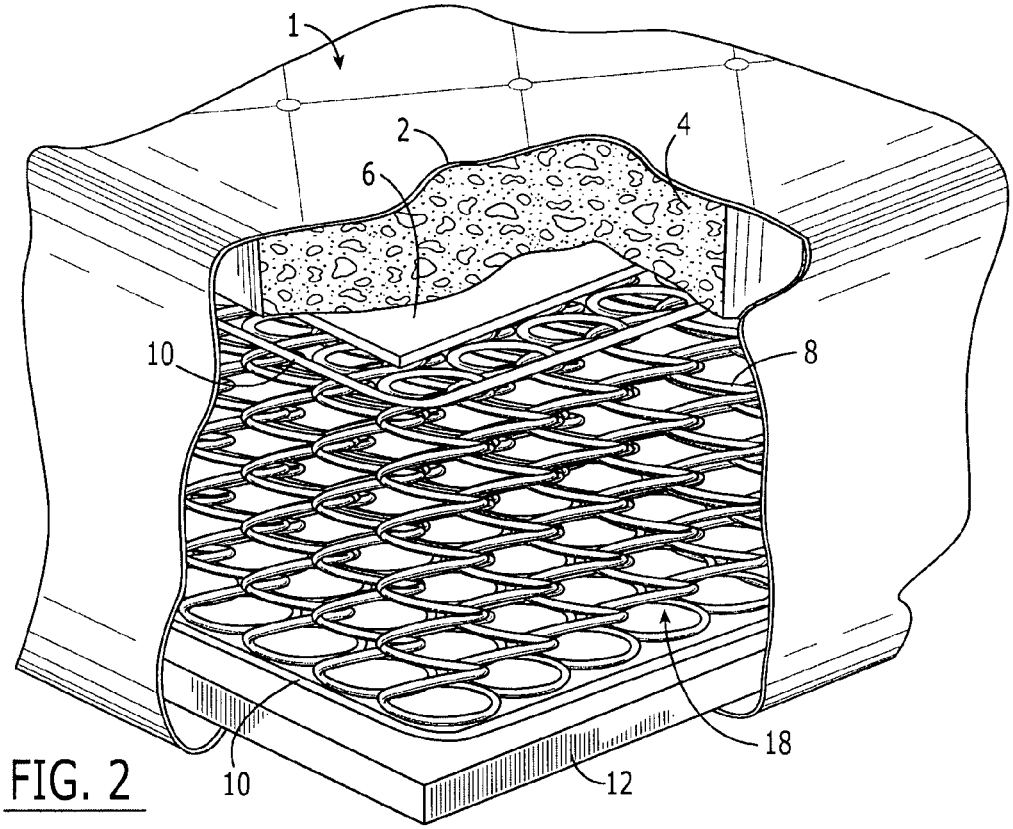
FIG. 2 is an enlarged view of the portion so indicated in FIG. 1.

Referring to the drawings, and particularly to FIG. 1, a mattress 1 is shown with the corner cut away to reveal the inner mattress unit 18. While the invention works regardless of mattress size, FIG. 1 is shown in approximately a twin size. Twin-, double-, queen-, and king-sized mattresses are well known in the art of mattress making, as are their approximate dimensions. Referring also to FIG. 1A, inner mattress unit 18 is formed of a plurality of coil springs 8 that fill much of the area within the mattress 1. Preferably, the coil springs 8 are made of steel or another suitable material and are usually attached to one another by metal wire, twine, adhesive, or other suitable means. The coil springs 8 may have a higher or a lower spring constant in certain areas of the mattress to match the expected loading in such areas. As shown in FIG. 2, wires 10 extend along the respective upper and lower perimeter of unit 18 to hold the coil springs 8 together and delineate the top and bottom sides of unit 18.

It is known in the art that the individual coil springs may be encased with a textile layer and adhered to adjacent springs with adhesive. Forming "pocketed coils" in this manner is thought to increase independence of the motion of each individual spring. Thus, when one user moves, another user on the other side of the bed is less likely to feel the motion of the first user. Alternatively to coil springs 8, some mattresses are constructed with an inner mattress unit formed of a thick layer of foam (instead of coil springs 8). Regardless of the type of spring or foam used in the inner mattress unit, the present invention functions to inhibit the formation of body impressions.

Mattresses generally are between eight and twenty inches thick. Of this eight to twenty inches, about six inches is the thickness of the inner mattress unit (unless the mattress has two inner mattress units, as discussed below). Thus, around two to sixteen inches of the mattress generally is cushioning between the inner mattress unit and the outer cover. Those of skill in the art may preferably select a predetermined thickness and type of cushioning to create a mattress with desired firmness and cost attributes.

In this regard, FIG. 1A illustrates a first cushion top 4 preferably formed of latex foam, polyurethane foam, textiles, any other suitable materials (or a combination of these materials). The thickness, density, and firmness of the first cushion top 4 are selected based on a mattress' desired height, desired firmness, and desired cost. In addition, it is well-known in the art to use layers of these materials to construct first cushion top 4 between outer cover 2 and the inner mattress unit 18. Layering different materials on top of one another to form a composite cushion top (for example, using foam and textile layers) is known in the art to combine the positive attributes of both materials. Thus, the term "cushion top" could describe a broad array of cushioning systems within a mattress.

Outer cover 2 encases the entire mattress. Preferably, the outer cover is comprised of a flexible textile material, or upholstery. Alternatively, the outer cover could be comprised of any flexible material with sufficient strength for use in a mattress. Plastics, man-made fibers, natural fibers, rubbers, any other suitable material, or any combinations of these materials preferably may constitute the outer cover. In addition, the outer cover may be treated with an antimicrobial treatment to resist allergens, dust mites, and other bacterial growth. The outer cover preferably is sewn together and reinforced along its edges, although other suitable methods of forming the outer cover could be utilized.

The user of the mattress loads and unloads the mattress by lying down on the mattress to sleep every night and getting up in the morning. Because the weight of the user is concentrated in a small area (the area where the user's body contacts the mattress during sleep), body impressions tend to form in that particular area. To resist the formation of body impressions, mattress 1 is preferably provided with a raised sleep zone. Preferably, the raised sleep zone may be formed by material located between inner mattress unit 18 and outer cover 2.

In many preferred embodiments of the present invention, the raised sleep zones are formed by one or more inserts (such as insert 6), preferably made of foam. The inserts fight the formation of body impressions in two ways. First, they delay the formation of body impressions by adding another layer of padding. Second, the inserts are located in the correct position and created in the correct size to fill the volume within the mattress where body impressions usually form.

As shown, insert 6 is disposed within the mattress 1 and located in an area within the mattress 1 where body impressions are likely to otherwise form. In the illustrated embodiment, insert 6 is located between the springs 8 and a first cushion top 4 in the illustrated embodiment. The thickness and other characteristics of the insert 6 or any other raised sleep zone embodiment may be selected without undue experimentation. For example, work of the present inventor has shown that inserts of about one inch in a one-sided mattress and one-half inch in each side of a two-sided mattress works well. The planar surface area of the raised sleep zone(s) is preferably less than the planar surface area of the first cushion top or the planar surface area of the inner mattress unit. When discussing the physical attributes of a raised sleep zone, the planar surface of raised sleep zone is the surface of the raised sleep zone that is substantially parallel to the sleep surface of the mattress.

By one-sided, it is meant that the user sleeps on only one side of the mattress; no mattress flipping is required. With a two-sided mattress, the inside of the mattress is symmetrical so that the user periodically can flip the mattress and wear both sides of the mattress evenly. Other insert thicknesses are also contemplated, and may work well in particular applications. One skilled in the art will appreciate that changes in the material properties or type of material chosen for the raised sleep zone (foam, textile, high density, etc.) can vary the ideal thickness of the raised sleep zone.

The size and shape of the raised sleep zone should augment the area within the mattress where body impressions form. If a mattress is normally used by only a single user, then a single raised sleep zone positioned in the area of the mattress where the user is expected to sleep (the center in most applications) can be provided. If two users normally use a mattress (as is usually the case with queen- and king-sized mattresses), then two raised sleep zones, one on each lateral side of the mattress, could be provided. Preferably, the shape of the raised sleep zones is rectangular. However, the use of oblong oval and other shapes similar to the shape of a user's contact patch with a mattress while sleeping are contemplated by the present invention.

FIG. 2 shows the springs 8, first insert 6, and first cushion top 4 located atop a foam base 12. Preferably, the foam base 12 is formed of relatively rigid foam that forms a platform supporting the remainder of the cushioning system. The thickness of the foam base 12 could vary depending on the density and stiffness of the foam used in the foam base. A base constructed of materials other than foam (e.g., wood, plastic, resin, metal) is also envisioned by the present invention. As one skilled in the art will recognize, a foam base 12 is only present on a one-sided mattress 1.

Figure 3:
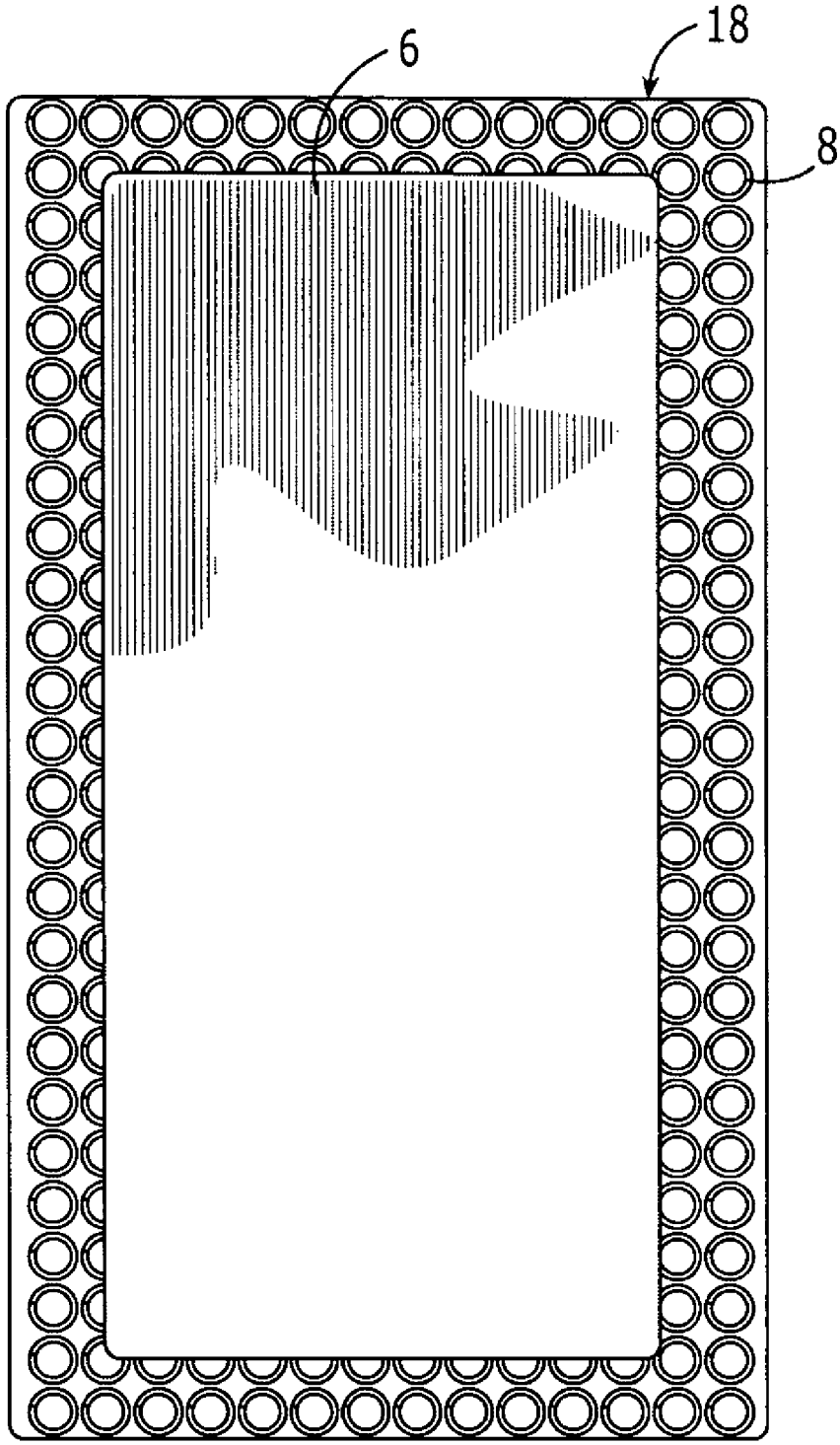
FIG. 3 is a top plan view of a twin-sized inner mattress unit shown with one insert located thereon.

Referring now also to FIG. 3, insert 6 is shown in position on top of inner mattress unit 18. (The outer cover 2 and first cushion top 4 are not shown in this Figure.) As shown, insert 6 has a planar face that is smaller than the size of the first cushion top 4 and inner mattress unit 18. Said another way, insert 6 does not extend to the edges of inner mattress unit 18. Insert 6 is of this smaller size so that it does not significantly affect the overall thickness at the edges of the mattress, but will bolster the area where body impressions are likely to occur. By placing insert 6 directly on the inner mattress unit 18, it has been found that the user will not notice an unpleasant hump in the mattress. Preferably, insert 6 will be attached to unit 18, such as by "hog ties" or glue, before other steps in the assembly of the mattress.

Different types of foam have different properties that make them advantageous in certain applications. The mattress industry predominantly uses polyurethane foam in all parts of the mattress, but occasionally uses latex foam. In some preferred embodiments of the present invention, the density of the foam used for the inserts may preferably be about 1.2 lbs. per cubic foot, and the stiffness of the foam may preferably be about 32 ILD. In general, the density and stiffness of foams used in mattresses are between 1 to 1.8 lbs. per cubic foot and 10 to 70 ILD respectively.

Figure 4:
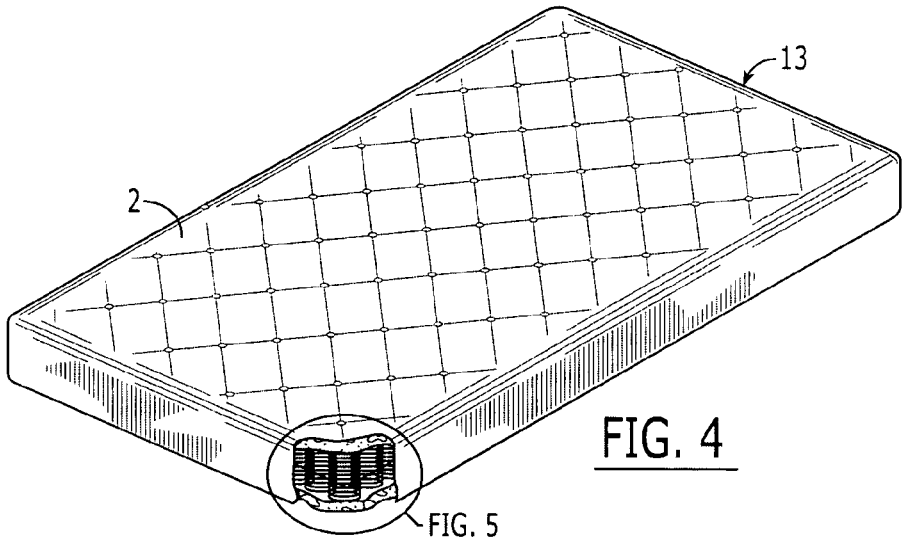
FIG. 4 is a view similar to FIG. 1 but showing a two-sided mattress.
Figure 5:
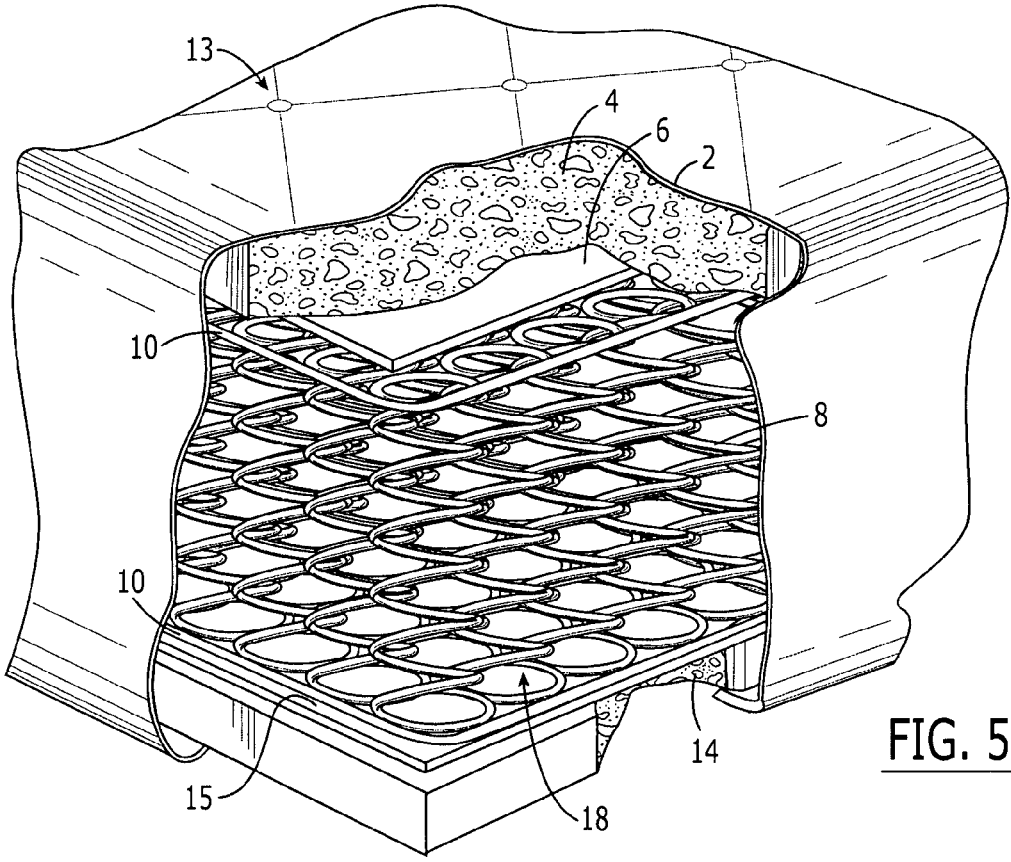
FIG. 5 is an enlarged view of the portion so indicated in FIG. 4.

FIGS. 4 and 5 show a cut-away view of the corner of a two-sided mattress 13. In addition to the first cushion top 4 and first insert 6 on the top side of the inner mattress unit 18, this two-sided embodiment has a second insert 15 located adjacent to the bottom of the inner mattress unit 18 and a second cushion top 14 so that the mattress is symmetrical. As in the case of one-sided mattress 1, two-sided mattress 13 is encased in an outer cover 2. As noted above, inserts 6, 15 are preferably thinner in this two-sided mattress 13 than in one-sided mattress 1.

Figure 6:
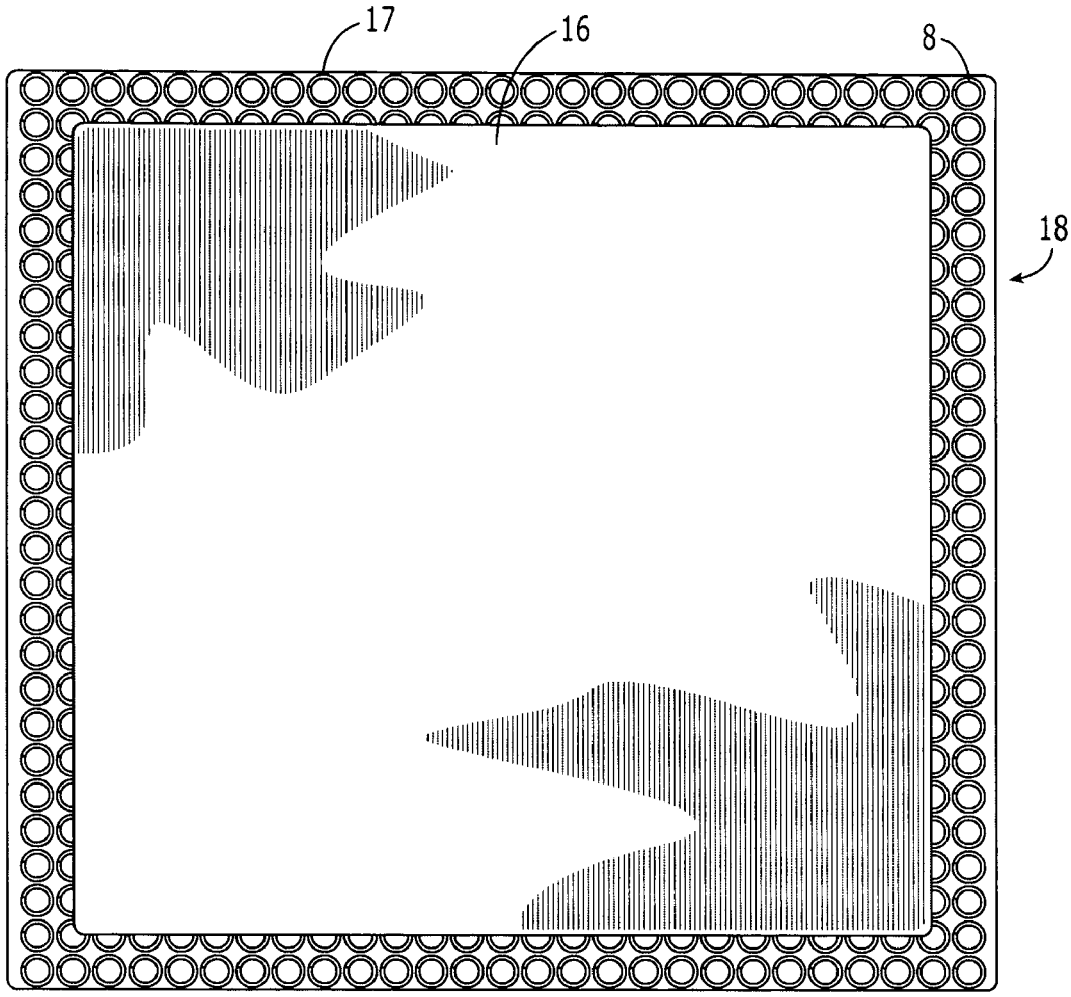
FIG. 6 is a top plan view of a double- or queen-sized inner mattress unit with one insert located thereon.

FIG. 6 shows a top view of a double- or queen-sized inner mattress unit 18 with a single insert 16. (In FIG. 6, the outer cover 2 and the first cushion top 4 are not shown.) Insert 16 covers over an area of the springs 8 where a user (or users) might sleep. As such, insert 16 preferably does not extend to the edge of the inner mattress unit 18. In addition, a second insert could be placed on the other side of the inner mattress unit 18 in a two-sided mattress.

Figure 7:
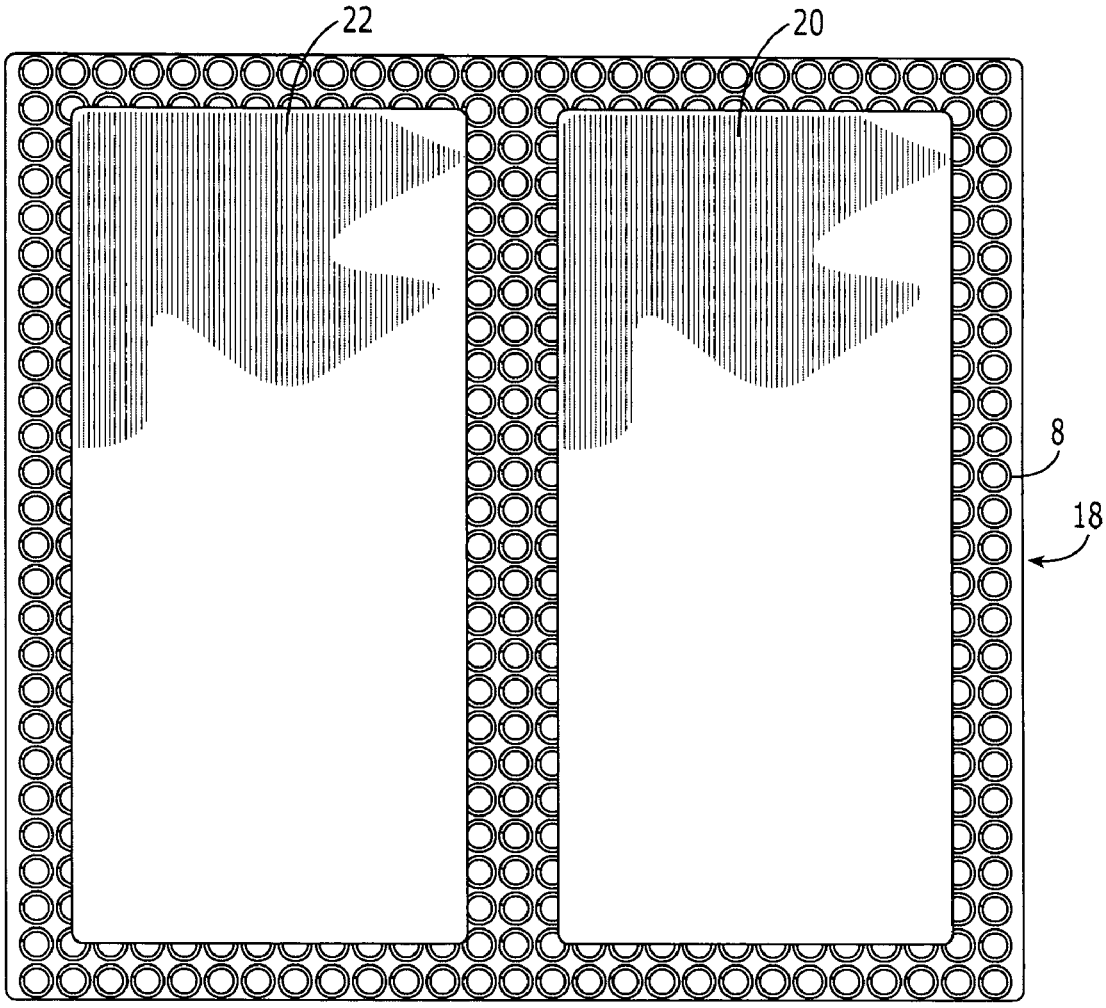
FIG. 7 is a top plan view of a double- or queen-sized inner mattress unit with two inserts located side-by-side thereon.

FIG. 7 shows a top view of a double- or queen-sized inner mattress unit 18 with first and second inserts 20, 22 in a side-by-side configuration. (As in FIG. 6, outer cover 2 and the first cushion top 4 are not shown.) The first and second inserts 20, 22 cover two areas on a mattress where respective users might sleep and thus fill an area in the mattress where body impressions would otherwise form. The inner mattress unit 18 could also be equipped with third and fourth inserts on the opposite side of the inner mattress unit 18 in a two-sided mattress.

Figure 8:
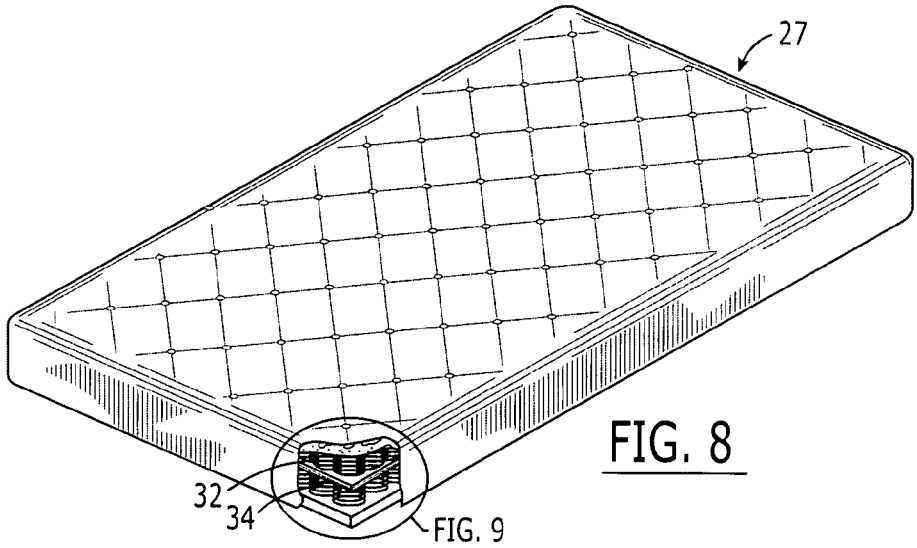
FIG. 8 is perspective view of a dual inner unit mattress with outer layers cut away in one corner to show internal details.
Figure 9:
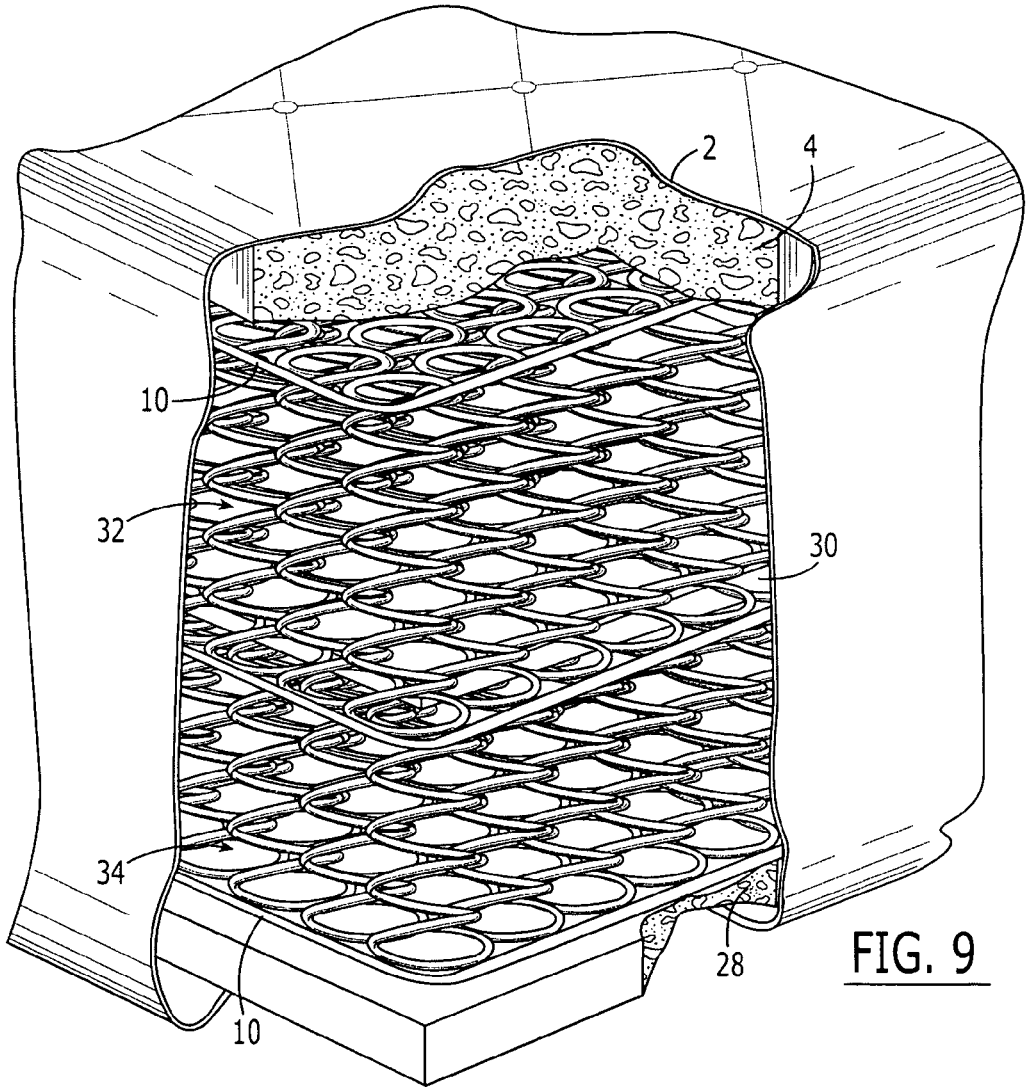
FIG. 9 is an enlarged view of the portion so indicated in FIG. 8.

FIGS. 8 and 9 show a cut-away view of a dual inner mattress unit mattress 27. A premium mattress of this type preferably is comprised of a first inner mattress unit 32 on top of a second inner mattress unit 34. Between the first and second inner mattress units 32, 34 is an insert 30. A first cushion top 4 and a second cushion top 28 are located along the top and bottom of the dual inner mattress unit mattress 27. An outer cover 2 encases the entire mattress 27.

The thickness of the insert 30 may preferably be about one inch in many contemplated embodiments. Because of the location of the insert 30, in the center of the mattress, this configuration makes it unlikely that a user would even notice the presence of insert 30 in the mattress. The dual inner mattress unit mattress 27 could use a single insert similar to that in FIG. 6, or use two side-by-side inserts similar to that in FIG. 7.

Figure 10:
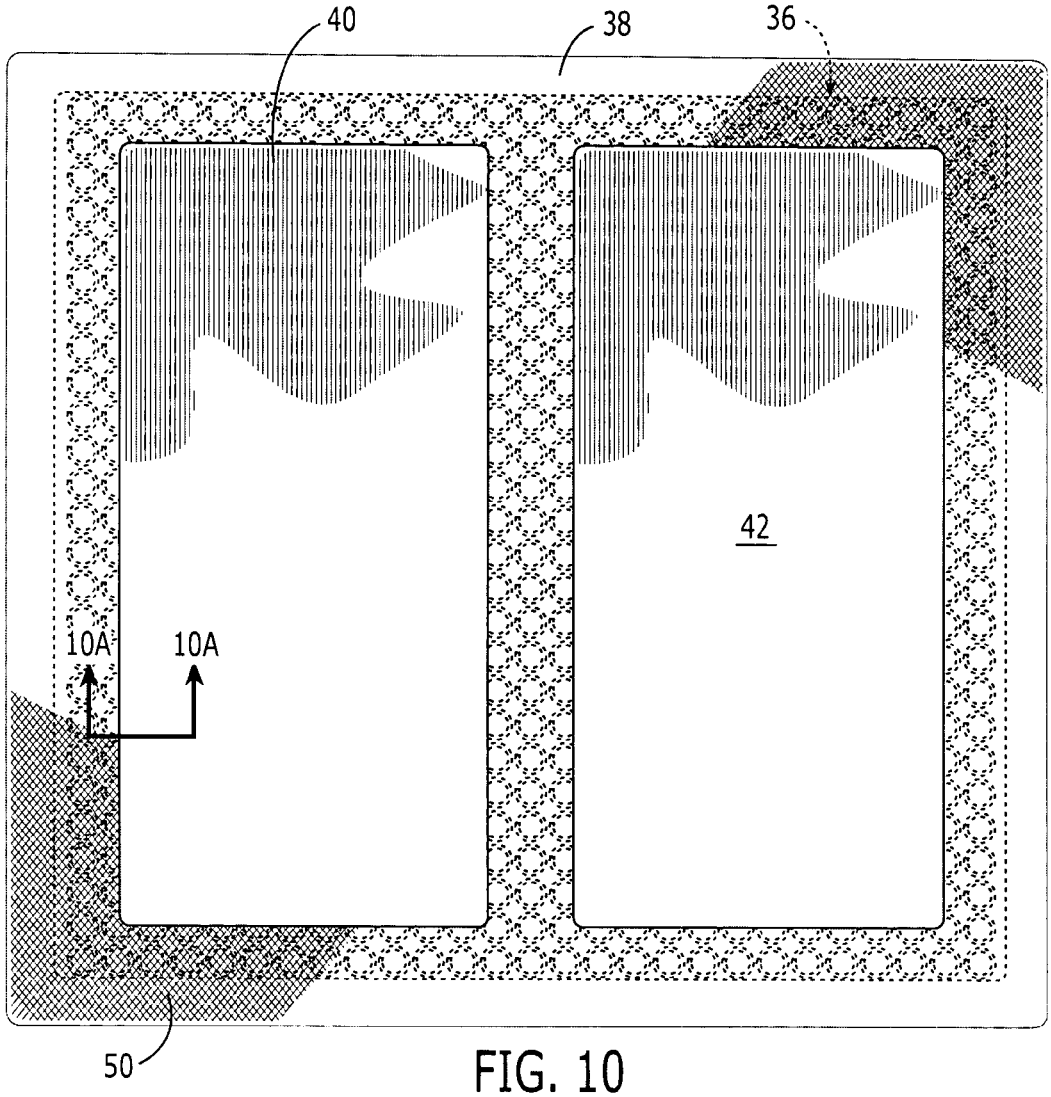
FIG. 10 is a top view of two inserts located side-by-side thereon and attached to a stabilizing layer.
Figure 10A:
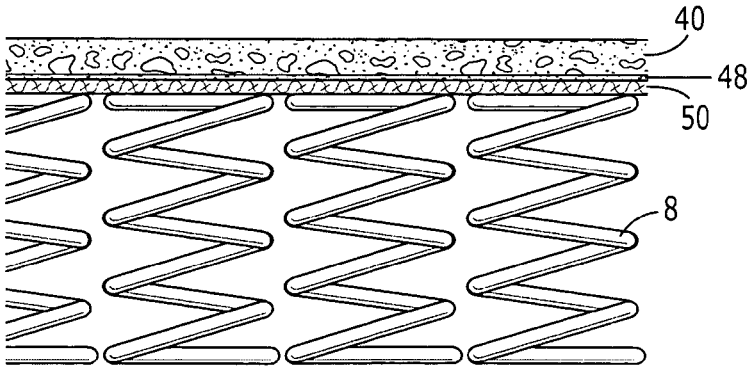
FIG. 10A is a cross-sectional view of a portion of the arrangement in FIG. 10.

FIG. 10 is a top view of two substantially planar inserts 40, 42 attached to a stabilizing layer 50. The stabilizing layer 50 could be made of a textile mesh, wire mesh, solid textile sheet, plastic sheet, or any other suitable material located on the planar face of inner mattress unit 36. Preferably, as shown in FIG. 10A, the planar insert 40 (or 42) is attached to the stabilizing layer 50 by means of an adhesive 48. The stabilizing layer 50 may or may not be attached to the inner mattress unit below. The stabilizing layer 50 with the inserts 40, 42 attached can be used as a separate unit in the manufacturing process. One advantage of having the inserts 40, 42 pre-attached to the stabilizing layer 50 is that the inserts 40, 42 are pre-positioned on the stabilizing layer 50, simplifying the process of assembling the mattress.

FIG. 10 also shows side rails 38 around the perimeter of inner mattress unit 36. These side rails 38 preferably are comprised of stiff foam that improves the stiffness of the edge of the mattress. The side rails 38 may or may not be encased in a perimeter of softer foam to make the edges of the mattress somewhat softer. The side rails 38 improve the durability and stiffness of the edge of the mattress, enabling the user to sit on the edge of the mattress and enlarging the usable area of the mattress. In addition, a mattress with a foam perimeter is often less likely to "crown," a condition where the edge of the mattress becomes permanently depressed from a user sitting on the edge over time.

While one or more preferred embodiments of the invention have been described above, it should be understood that any and all equivalent realizations of the present invention are included within the scope and spirit thereof. For example, the raised sleep zone could be formed of a suitable material other than foam located between first cushion top 4 and inner mattress unit 18. Alternately, the insert could be positioned just below outer cover 2, i.e., between first cushion top 4 and outer cover 2. Yet another possible configuration of the raised sleep zones is to have the raised sleep zones as a unitary part of first cushion top 4. This latter embodiment would make for easy installation of the unitary cushion top/raised sleep zone member. In addition, one skilled in the art will appreciate that many differing internal configurations are possible due to the use of more or less internal cushioning for the creation of softer or firmer mattresses.

The embodiments depicted are presented by way of example and are not intended as limitations upon the present invention. Thus, those of ordinary skill in this art should understand that the present invention is not limited to these embodiments since modifications can be made. Therefore, it is contemplated that any and all such embodiments are included in the present invention as may fall within the scope and spirit thereof of the appended claims and their equivalents.

What is claimed:

1. A mattress with at least one raised sleep zone, said mattress comprising:

an inner mattress unit having opposite first and second sides;

an outer cover surrounding the inner mattress unit;

a first cushion top of a predetermined thickness positioned between the first side of the inner mattress unit and the outer cover; and at least one raised sleep zone between the outer cover and the first side of the inner mattress unit, wherein the planar surface area of the at least one raised sleep zone is less than the planar surface area of the first side of the inner mattress unit, wherein the at least one raised sleep zone is sized and positioned to inhibit the formation of body impressions, and wherein the at least one raised sleep zone is positioned between the outer cover and the first cushion top.

2. A mattress as in claim 1 wherein the at least one raised sleep zone is a foam insert.

3. A mattress with at least one raised sleep zone, said mattress comprising:

an inner mattress unit having opposite first and second sides;

an outer cover surrounding the inner mattress unit;

a first cushion top of a predetermined thickness positioned between the first side of the inner mattress unit and the outer cover; and at least one raised sleep zone between the outer cover and the first side of the inner mattress unit, wherein the planar surface area of the at least one raised sleep zone is less than the planar surface area of the first side of the inner mattress unit, wherein the at least one raised sleep zone is sized and positioned to inhibit the formation of body impressions, and wherein the at least one raised sleep zone comprises two raised sleep zones located side-by-side between the outer cover and the first side of the inner mattress unit.

4. A mattress as in claim 3 wherein the at least one raised sleep zone further comprises third and fourth raised sleep zones located side-by-side between the outer cover and the second side of the inner mattress unit.

5. A mattress as in claim 3 wherein each raised sleep zone is about one-half an inch thick.

6. A mattress with raised sleep zones to inhibit the formation of body impressions, said mattress comprising:

an inner mattress unit having a rectangular box shape;

the inner mattress unit having opposite first and second sides;

a first insert adjacent to the first side of the inner mattress unit, the first insert configured and positioned to inhibit the formation of body impressions;

the first insert having a planar surface area less than the surface area of the first side of the inner mattress unit;

a first cushion top of a predetermined thickness configured to cover the first insert and a part of the first side of the inner mattress unit not covered by the first insert; and an outer cover; and wherein the first insert is comprised of textiles.

7. A mattress as in claim 6 wherein the first cushion top is comprised of foam.

8. A mattress as in claim 7 wherein the density of the first insert is in the range of 1 pound per cubic foot to 2 pounds per cubic foot.

9. A mattress as in claim 7 wherein the firmness of the first insert is between 10 ILD and 70 ILD.

10. A mattress as in claim 6 wherein the first cushion top is comprised of at least one foam layer and at least one textile layer.

11. A mattress as in claim 8 further comprising a foam base located adjacent to the second side of the inner mattress unit.

12. A mattress as in claim 6 wherein the inner mattress unit is comprised of a plurality of individual pocketed coil springs.

13. A mattress as in claim 6 wherein the inner mattress unit is comprised of a plurality of individual and interconnected coil springs.

14. A mattress as in claim 6 wherein the inner mattress unit is comprised of a foam core.

15. A mattress as in claim 6 further comprising side rails around the perimeter of the inner mattress unit to improve the stiffness of the edges.

16. A mattress as in claim 15 wherein a foam perimeter encases the side rails.

17. A mattress as in claim 6 further comprising a second insert of about the same size as the first insert, the second insert located adjacent to the second side of the inner mattress unit.

18. A mattress as in claim 17 further comprising a second cushion top configured to cover the second insert and a part of the second side of the inner mattress unit not covered by the second insert.

19. A mattress with raised sleep zones to inhibit the formation of body impressions, said mattress comprising:

an inner mattress unit having a rectangular box shape;

the inner mattress unit having opposite first and second sides;

a first insert adjacent to the first side of the inner mattress unit, the first insert configured and positioned to inhibit the formation of body impressions;

the first insert having a planar surface area less than the surface area of the first side of the inner mattress unit;

a first cushion top of a predetermined thickness configured to cover the first insert and a part of the first side of the inner mattress unit not covered by the first insert;

an outer cover;

wherein the first insert and the first cushion top are comprised of foam; and wherein the density of the first insert is greater than the density of the first cushion top.

20. A mattress as in claim 19 wherein the density of the first insert is in the range of 1 pound per cubic foot to 2 pounds per cubic foot.

21. A mattress as in claim 19 wherein the firmness of the first insert is between 10 ILD and 70 ILD.

22. A mattress as in claim 19 wherein a thickness of the first insert is no greater than about one inch.

23. A mattress with raised sleep zones to inhibit the formation of body impressions, said mattress comprising:

an inner mattress unit having a rectangular box shape;

the inner mattress unit having opposite first and second sides;

a first insert adjacent to the first side of the inner mattress unit, the first insert configured and positioned to inhibit the formation of body impressions, wherein the first insert is comprised of foam;

the first insert having a planar surface area less than the surface area of the first side of the inner mattress unit;

a first cushion top of a predetermined thickness configured to cover the first insert and a part of the first side of the inner mattress unit not covered by the first insert;

an outer cover; and a second insert located side-by-side with the first insert on the first side of the inner mattress unit.

24. A mattress as in claim 23 wherein a thickness of said inserts is no greater than about one inch.

25. A mattress as in claim 23 further comprising third and fourth inserts located side-by-side and adjacent to the second side of the inner mattress unit.

26. A mattress as in claim 25 wherein each insert is about one-half an inch thick.

27. A mattress as in claim 25 further comprising a second cushion top configured to cover the third and fourth inserts and a part of the second side of the inner mattress unit not covered by the third and fourth inserts.

28. A mattress with raised sleep zones to inhibit the formation of body impressions, the mattress comprising:

an inner mattress unit having a rectangular box shape;

the inner mattress unit having opposite first and second sides;

a first insert adjacent to the first side of the inner mattress unit;

a second insert located side-by-side with the first insert on the first side of the inner mattress unit;

a first cushion top of a predetermined thickness configured to cover the first and second inserts and a part of the first side of the inner mattress unit not covered by the first and second inserts; and an outer cover.

29. A mattress as in claim 28 wherein the first and second inserts are comprised of foam.

30. A mattress as in claim 29 comprising a foam base located adjacent to the second side of the inner mattress unit.

31. A mattress as in claim 28 further comprising side rails around the perimeter of the inner mattress unit to improve the stiffness of the edges.

32. A mattress as in claim 31 wherein a foam perimeter encases the side rails.

33. A cushioning system with inserts to inhibit the formation of body impressions, the cushioning system comprising:

first and second inner mattress units having a rectangular box shape, each inner mattress unit having opposite first and second sides;

the surface area of the first and second opposite sides of the first and second inner mattress units being approximately equal;

a first insert and a second insert, the first and second inserts having a combined planar surface area less than the surface area of the first and second opposite sides of the first and second inner mattress units; and the first and second inserts being located side-by-side and between the first and second inner mattress units, thereby forming a cushioning system.

* * * * *